US006032984A

United States Patent [19]

Ishida

[11] Patent Number: 6,032,984

[45] Date of Patent: Mar. 7, 2000

[54] MID-DIGIT COLOR CODED FILING SYSTEM AND FOLDERS

[75] Inventor: Kazumichi Ishida, Tokyo, Japan

[73] Assignee: Visca Medical Filing Co., Ltd., Tokyo, Japan

[21] Appl. No.: 08/935,022

[22] Filed: Sep. 22, 1997

[51] Int. Cl.[7] ..... B42D 15/00

[52] U.S. Cl. ..... 283/70; 283/114; 283/37; 40/359

[58] Field of Search ..... 283/67, 70, 72, 283/101, 81, 36, 38, 42, 37; 40/359

[56] References Cited

U.S. PATENT DOCUMENTS

| | | | |
|---|---|---|---|
| 3,142,437 | 7/1964 | Grant et al. | 229/67.1 |
| 3,814,527 | 6/1974 | Lawes | 281/45 |
| 3,937,493 | 2/1976 | Fasbender . | |
| 4,175,777 | 11/1979 | Horn | 283/42 |
| 4,204,639 | 5/1980 | Barber et al. | 235/462 |
| 4,247,999 | 2/1981 | Latino | 40/359 |
| 4,445,711 | 5/1984 | Cunningham | 283/81 |
| 4,523,776 | 6/1985 | Barber | 283/39 |
| 4,544,182 | 10/1985 | Spring | 283/42 |
| 4,715,621 | 12/1987 | Colavito et al. | 283/36 |
| 4,844,509 | 7/1989 | Kasprzak et al. | 283/81 |
| 5,174,606 | 12/1992 | Hure | 281/45 |
| 5,197,764 | 3/1993 | Hicinbothem et al. | 283/81 |
| 5,288,107 | 2/1994 | Johnson et al. | 283/81 |
| 5,395,137 | 3/1995 | Kim | 283/101 X |
| 5,449,202 | 9/1995 | Nalepka et al. | 283/81 |

*Primary Examiner*—Willmon Fridie, Jr.

*Attorney, Agent, or Firm*—Schweitzer Cornman Gross & Bondell LLP

[57] ABSTRACT

A method for a color coded filing system uses color codes for the sequencing elements of a sequencing scheme to provide unique color codes for the file designations of individual files. The method omits the color code for the last sequencing element of the file designation such that, when multiple files are arranged in order, the color codes form horizontal rows of easily discernible color blocks where the color blocks span multiple files. The file folder used in conjunction with the method has a pocket for a removable color code carrying medium. The pocket includes a window on the outside edge of the file folder. The window is aligned with the color codes on the carrying medium to permit direct viewing of the color codes. A graspable portion of the carrying medium extends through the window to aid in insertion and removal of the carrying medium.

5 Claims, 4 Drawing Sheets

FIG. 4
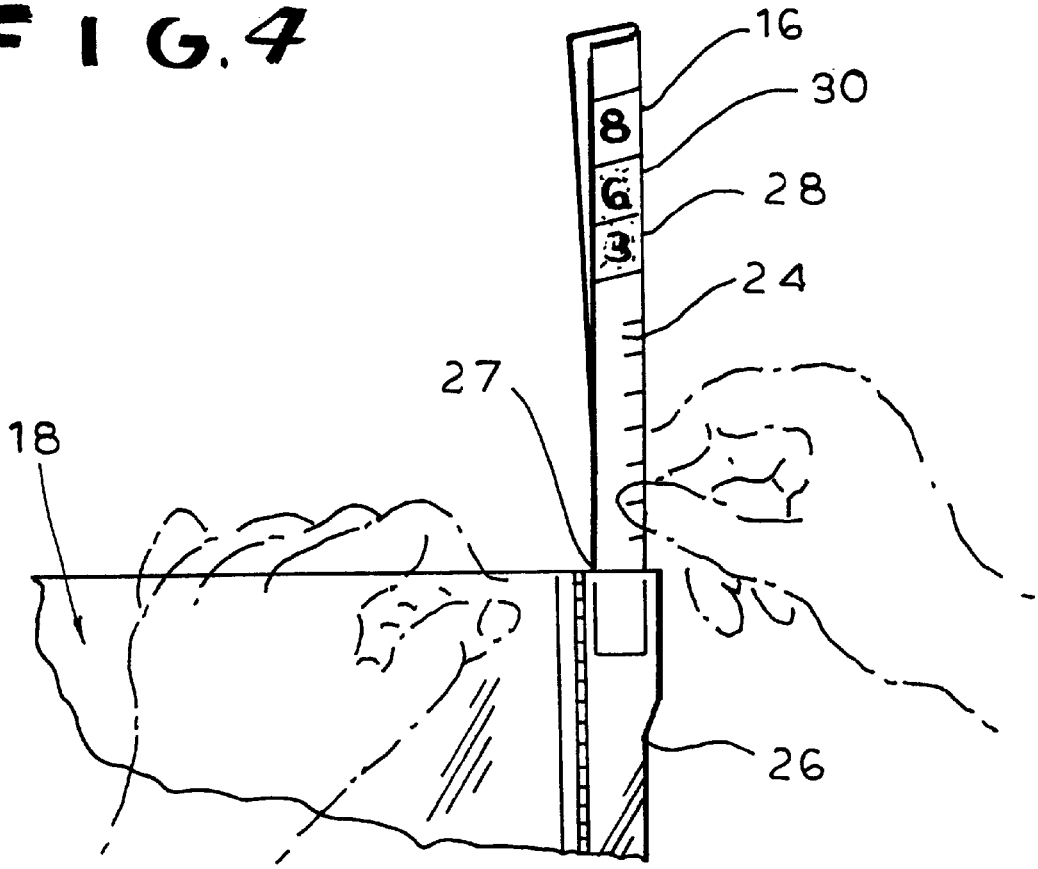
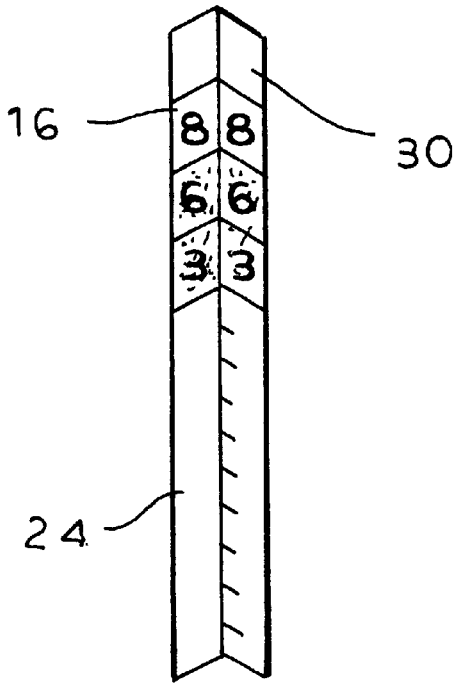
FIG. 3

MID-DIGIT COLOR CODED FILING SYSTEM AND FOLDERS

FIELD OF THE INVENTION

This invention pertains to the field of filing systems, and in particular to filing systems employing color codes.

BACKGROUND AND SUMMARY OF THE INVENTION

The particular files in a filing system are typically organized according to a file designation which is chosen according to some sequencing scheme such as a numerical scheme or an alphabetical scheme, or a combination thereof. The characters or numerals of such sequencing schemes will be generally referred to as sequencing elements. The file designation, which is simply a unique series of the sequencing elements, is typically written onto the face and/or back of the file. However, the file designation is typically not visible when the files are inserted into the drawer or placed on the shelf. To overcome this problem, it is known to include color codes on the edges of the files, which codes are associated with the characters or numerals of the file designation. In particular, each sequencing element in the sequencing scheme is assigned a unique color code. The color codes associated with a particular file designation are then affixed to the outer edge of the file. Thus, for example, with a numerical filing system the number zero may be assigned the color red, one assigned the color orange, two assigned the color yellow, three assigned the color green, four assigned the color blue, and so on. Thus, file 123 would have the color code orange, yellow, green. The neighboring file, 124, would have the color code orange, yellow, blue, and so on.

The color codes are affixed to the outer edges of the adjacent files in a vertical column and are aligned such that they form color blocks when the files are arranged in the drawer or on the shelf. However, since each of the numerals (or characters) of the file designation is color coded, the color block or bar associated with the last digit or character of the file designation (e.g., the 1's digit in a straight numerical sequencing scheme) can form a confusing rainbow array of closely spaced colors which can inhibit the usefulness of the color coding system. Furthermore, in previously known color coded filing systems, the color codes are either permanently affixed or at least semi-permanently affixed to the outward edge of the file, such as with pressure-sensitive adhesive stickers. This can make reorganization or reuse of the file folders difficult or impractical.

The method of the present invention improves upon previously known color coded filing methods by specifically omitting any color code on the last digit or character of the file designation. As in other color coded filing systems, each digit in the sequencing scheme is assigned a unique color code. However, for example, in a straight numerical sequencing scheme, the last digit of the file designation (i.e., the 1's digit) is not color coded, while the 10's, 100's and 1000's digits, and those above are color coded. In this manner, there is a group of adjacent rows of color blocks. One row for each of the 10's, 100's, and 1000's digits, etc. The 1's digits, being non-color coded, would not produce any color row or any confusing array of colors as found in the prior art. The present system is also adaptable to a reverse numerical or "terminal digit" sequencing scheme, wherein the files are organized by reading the file designation in reverse. In a terminal digit scheme, the first digit (e.g., the 1000's digit) is non-color coded and the 100's, 10's and 1's digits would be color coded.

The file folder associated with the inventive method is specifically designed to further enhance the visual discernibility of the color codes used in the filing system. Specifically, the file folder consists of a preferably clear polypropylene folder having a pocket on the outside edge for a removable, color code carrying medium such as a color coded sheet. The pocket includes a window along the outside edge to permit direct viewing of the carrying medium in the pocket. The window also facilitates insertion and removal of the carrying medium from the pocket. The pocket, carrying medium and color codes thereon are all designed such that when the carrying medium is fully inserted through the top of the pocket, the color codes are aligned and are visible through the window. The polypropylene folder provides a certain amount of rigidity for the materials contained therein. However, the file folder is relatively thin such that the color codes of adjacent files are closely adjacent one another so as to form substantially solid and visually perceptible color blocks.

BRIEF DESCRIPTION OF THE DRAWINGS

FIG. 3 is a photograph showing a perspective view of a color carrying medium in a partially folded position;

FIG. 4 is a side elevational view of a color code carrying medium being inserted into a file folder.

DETAILED DESCRIPTION OF THE INVENTION

Figure 1:
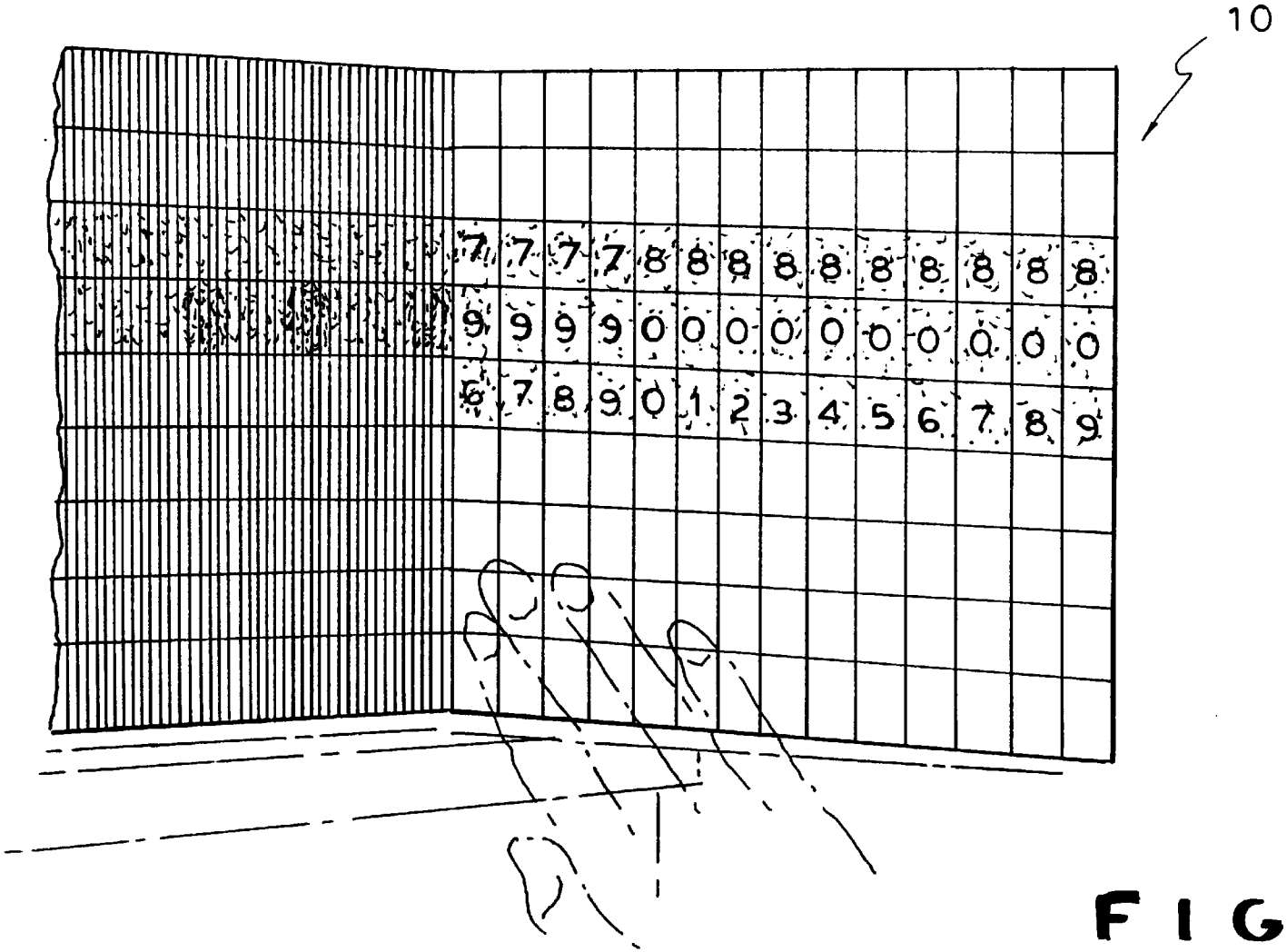
FIG. 1 is a photograph showing a perspective view of a filing system according to the invention.
Figure 2:
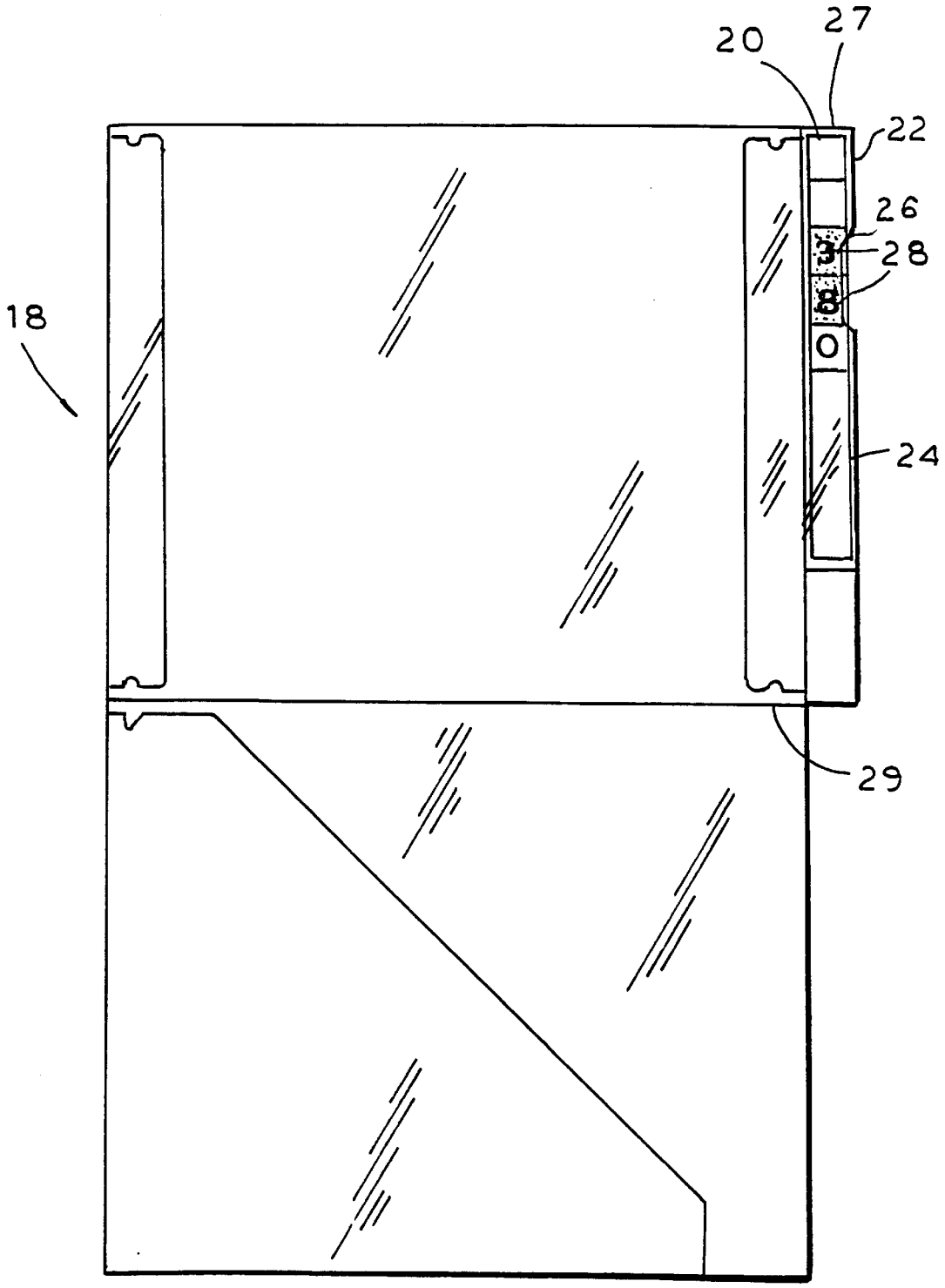
FIG. 2 is a side, elevational view of a file folder according to the invention.
Figure 5:
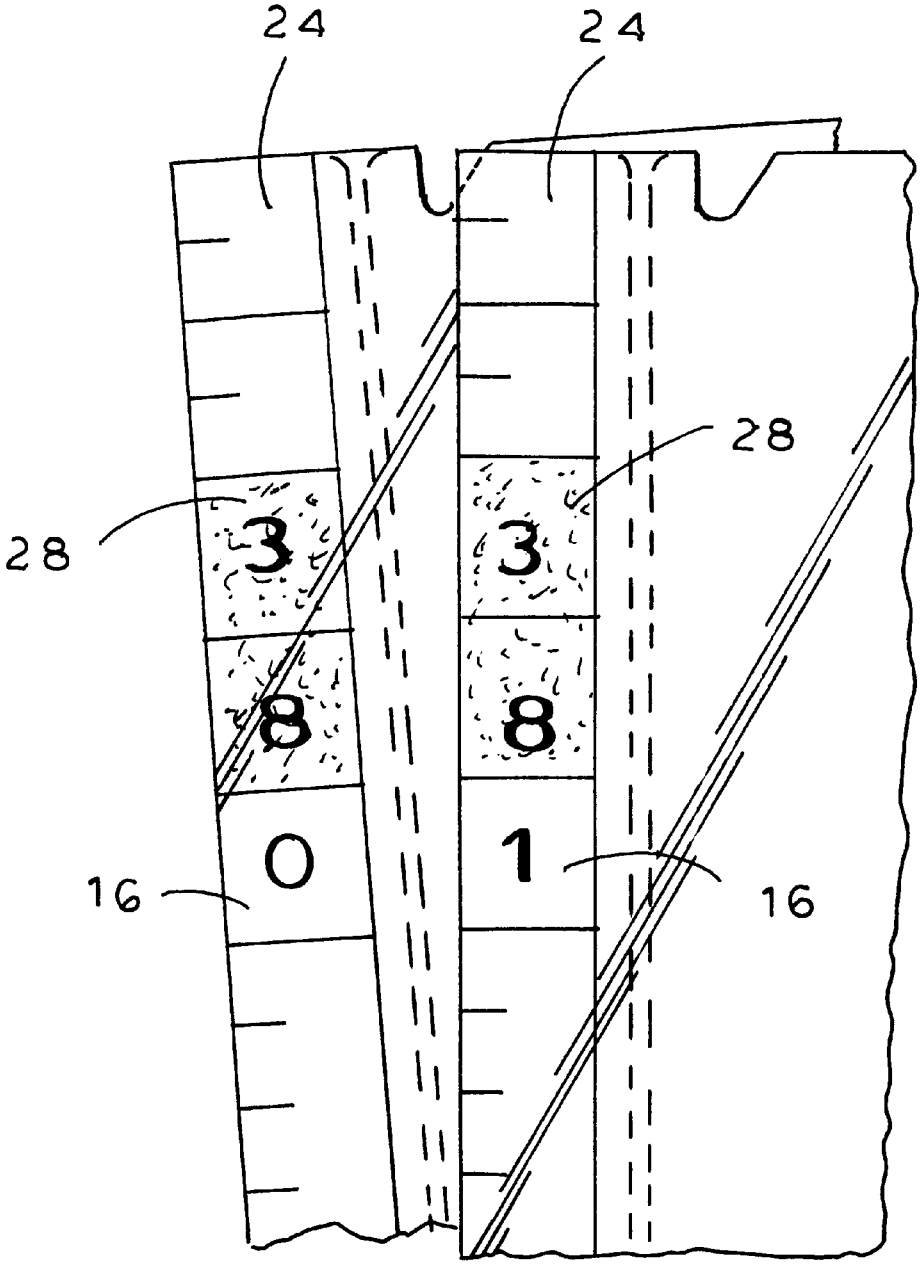
FIG. 5 is a closeup, side elevational view of a pair of file folders with color code carrying mediums fully inserted.

Referring to FIG. 1, in the filing system 10 of the present invention, the characters or numerals comprising the sequencing elements of a file sequencing scheme are assigned unique colors which are used to distinguish individual files by the color code produced by the file designation. The files are arranged in order according to the file designation such that the color codes of adjacent files form easily distinguishable color blocks for locating and replacing files. However, the last digit or character (e.g., the 1's digit) by which the files are sequenced, generally referred to by the reference numeral 16, remains non-color coded.

As can be appreciated, in a straight numerical sequencing scheme using numbers up to the 1000's digits, the color codes for the 10's, 100's and 1000's digits form color blocks each spanning or having a width of ten, one hundred and one thousand files respectively. Since the digit by which the files are organized (e.g., the 1's digit) remains non-color coded, the filing system 10 of the present invention avoids the often confusing rainbow array of colors produced in the row of color codes associated with the 1's digit. The filing system 10 is also applicable for reverse numerical sequencing schemes wherein, for example, the highest digit (e.g., the 1000's digit) would be non-color coded and the lower digits (e.g. the 100's, 10's and 1's digit) would be color coded. Also, while the numerical sequencing scheme herein described uses only up to 1000's digits, the invention is equally applicable to 10,000's digits and above.

Referring to FIGS. 2–5, the file folder 18, used in conjunction with the filing system 10 of the present invention is comprised of a preferably clear polypropylene folder having a pocket 20 on the outside edge 22 thereof for a removable, color code carrying medium such as the color coded sheet 24. The color coded sheet 24 preferably has a white or light colored code background and includes color blocks 28 associated with the character or numerals of the sequencing scheme. The characters or numerals, are preferably displayed within the color block in the background color of the sheet 24, or in black.

The folder 18 includes a window 26 outside of the pocket 20 (which is also the outside edge of the folder 18) which is aligned with the color codes 28 of the sheet 24 to enhance the visibility and vibrancy of the color codes 28. The window 26 also facilitates insertion and removal of the sheet from a top 27 of the pocket. The sheet 24 can be shorter than the depth of the pocket 20 such that, when fully inserted therein, the top 29 of the sheet 24 lies below the top 27 of the pocket 20. Thus, the portion of the sheet 24 which extends through the window 26 can be grasped to aid in insertion and removal of the sheet 24.

The pocket 20, sheet 24 and color codes 28 on the sheet are all designed such that, when the sheet is fully inserted in the pocket 20, the color codes 28 align with and are visible through the window 26. Preferably, the color codes 28 are closely spaced in a vertical column, which column is located a predetermined distance from a bottom 29 of the color coded sheet 24. Thus, when the sheet 24 is fully inserted into the pocket 20, the color codes 28 will be located at a uniform height from the bottom 29 of the folder 18. This, in turn, will form horizontal rows of color blocks when a plurality of folders 18 are grouped together.

Preferably, the sheet 24 includes a plurality of locations for color codes and/or numbers. Thus, for example when a straight numerical sequencing scheme is used, the 1000's, 100's and 10's digits and the color codes thereof can be aligned with the window 26, with the 1's digit therebelow (see FIGS. 2 and 5). In comparison, when a reverse or terminal digit sequencing is used, the 100's, 10's and 1's digits can be aligned with the window 26, with the 1000's digit thereabove (see FIGS. 3 and 4).

Preferably, the sheet 24 includes a score line 30 down the center thereof to facilitate folding of the sheet. The folded sheet 24 preferably has a width substantially equal to the width of the pocket 22 such that the sheet 24 fits snugly within the pocket 22 but is easily removable therefrom. Also, preferably the color codes 28 span the full width of the sheet 24 such that they are visible not only when the files are fully inserted, but also from the side when the files are partially or fully withdrawn.

The polypropylene material of the folder 18 provides a certain amount of rigidity to the folder itself and to the contents therein. In addition, the combination of the multiple layers forming the pocket 22 and the sheet therein adds a further amount of rigidity to the outside edge 22 of the folder. The rigidity provided to the contents by the folder, pocket and sheet assists in inserting and removing the individual files. The polypropylene material from which the folders are formed also minimizes the friction between adjacent files thereby reducing the effort required to insert and replace files. In addition, the front and back covers of the polypropylene file are of relatively thin (approximately 0.2 mm) which, as compared to previous designs, reduces shelf space required for a given number of files and, more importantly, decreases the distance between color codes of adjacent files thereby increasing the visual impact of the color bars created by adjacent files and increasing the ease with which the location of a given file can be identified.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A method for color-coding a filing system comprising the steps of:

selecting either a straight or reverse file sequencing scheme with a number of sequencing elements;

assigning a unique color code to each one of said sequencing elements;

providing a plurality of file folders, each with a bottom edge and an outside edge;

assigning a unique file designation according to said sequencing scheme for each of said file folders, said file designation comprising a series of said sequencing elements;

providing at least two color codes to each of said file folders on said outside edge thereof, said color codes being provided according to the sequencing elements of the file designation of the file folder;

said two color codes being arranged in a vertical column closely adjacent one another, each color code in said vertical column being spaced a predetermined distance from said bottom edge of said file folder;

omitting, in a straight file sequencing scheme, a color code for a last sequencing element in said series, or omitting, in a reverse file sequencing scheme, a color code for a first sequencing element in said series; and arranging said plurality of file folders together, in direct contact with one another and according to said file sequencing scheme;

whereby, when said file folders are arranged together, said two color codes form two closely-spaced, horizontal rows of easily-discernible color blocks, which color blocks each have a horizontal length spanning a plurality of outward edges of said file folders.

2. The method according to claim 1, wherein said step of providing a plurality of file folders further comprises providing a pocket located on said outside edge, said pocket having an opening adjacent a top thereof, having a window through said outside edge and having a bottom; and providing a color code carrying medium, said carrying medium being removably insertable into said pocket through said opening and having a fully inserted position;

said color codes are affixed to said carrying medium adjacent to one another in a vertical column spaced a predetermined distance from said bottom of said carrying medium; and said window being located to expose said color codes when said carrying medium is fully inserted into said pocket to permit direct viewing of said color codes through said window.

3. The method according to claim 2, wherein said carrying medium is shorter than a depth of said pocket such that, when fully inserted, a top of said carrying medium is below said opening of said pocket; and said window is configured to expose a sufficient portion of an intermediate portion of said carrying medium to permit grasping thereof to assist in the insertion and removal of said carrying medium.

4. A coded file folder, comprising (a) a folder having a pocket, said pocket forming an outside edge of said folder, said pocket having an opening and having a window located on said outside edge said window being spaced a distance from said opening; and (b) a color code carrying medium removably insertable into said pocket through said opening, said carrying medium including color codes which are substantially aligned with and are visible through said window when said carrying medium is fully inserted into said pocket;

(c) whereby said carrying medium and said folder are separately reusable, and said window permits direct viewing of said color codes to enhance the visual impact of said color codes.

5. A color coded file folder as in claim 4, wherein:

(a) an intermediate portion of said carrying medium extends through said window of said pocket when said carrying medium is fully inserted therein; and (b) said intermediate portion is of a sufficient size to grasp to assist in insertion and removal of said carrying medium.

* * * * *